US009677836B2

(12) United States Patent
Lee

(10) Patent No.: US 9,677,836 B2
(45) **Date of Patent: *Jun. 13, 2017**

(54) RESET ASSIST MECHANISM

(71) Applicant: Apex Tactical Specialties, Inc., Los Osos, CA (US)

(72) Inventor: Randall M. Lee, Los Osos, CA (US)

(73) Assignee: Apex Tactical Specialties, Inc., Peoria, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/837,767

(22) Filed: Aug. 27, 2015

(65) Prior Publication Data

US 2016/0040949 A1 Feb. 11, 2016

Related U.S. Application Data

(63) Continuation of application No. 14/341,837, filed on Jul. 27, 2014, now Pat. No. 9,146,065, which is a continuation of application No. 13/953,610, filed on Jul. 29, 2013, now Pat. No. 8,819,978, which is a continuation of application No. 12/912,715, filed on Oct. 26, 2010, now Pat. No. 8,510,980.

(51) Int. Cl.

| | |
|---|---|
| ***F41A 19/06*** | (2006.01) |
| ***F41A 19/10*** | (2006.01) |
| ***F41A 19/12*** | (2006.01) |
| ***F41A 19/31*** | (2006.01) |
| ***F41A 19/32*** | (2006.01) |

(52) U.S. Cl.

CPC ..... *F41A 19/06* (2013.01); *F41A 19/10* (2013.01); *F41A 19/12* (2013.01); *F41A 19/31* (2013.01); *F41A 19/32* (2013.01)

(58) Field of Classification Search

CPC ..... F41A 19/06; F41A 19/32

See application file for complete search history.

(56) References Cited

U.S. PATENT DOCUMENTS

| | | | |
|---|---|---|---|
| 1,240,068 | A | 9/1917 | Lytton |
| 1,934,731 | A | 11/1933 | Nahm |
| 4,026,056 | A | 5/1977 | Roman |
| 4,457,091 | A | 7/1984 | Wallerstein |

(Continued)

OTHER PUBLICATIONS

Final office action from U.S. Appl. No. 14/341,837 mailed Mar. 10, 2015.

(Continued)

*Primary Examiner* — Reginald Tillman, Jr.

(74) *Attorney, Agent, or Firm* — Fitch, Even, Tabin & Flannery LLP

(57) ABSTRACT

A reset apparatus for use in a firearm, comprising: a compression spring; a biasing member has a first end and a distal end wherein the compression spring is attached proximate to the first end of the biasing member; a notch disposed on the biasing member for cooperation with a trigger bar, wherein the trigger bar comprises a longitudinal axis defined by a front portion and a rear portion, wherein the front portion is mechanically cooperated with a firearm trigger; and wherein the compression spring communicates a force through the biasing member and onto the trigger bar in a direction substantially perpendicular to the longitudinal axis of the trigger bar.

15 Claims, 10 Drawing Sheets

(56) References Cited

U.S. PATENT DOCUMENTS

| | | | | |
|---|---|---|---|---|
| 4,682,435 | A | 7/1987 | Heltzel | |
| 6,354,032 | B1 | 3/2002 | Viani | |
| 6,401,377 | B1 | 6/2002 | Vendetti | |
| 6,412,206 | B1 | 7/2002 | Strayer | |
| 6,425,199 | B1 | 7/2002 | Vaid | |
| 7,617,628 | B2 | 11/2009 | Curry | |
| 8,186,087 | B2 | 5/2012 | Ogershok | |
| 8,510,980 | B2 | 8/2013 | Lee | |
| 8,819,978 | B2 | 9/2014 | Lee | |
| 9,146,065 | B2 * | 9/2015 | Lee | F41A 19/10 |
| 2006/0048426 | A1 | 3/2006 | Crandall | |
| 2010/0175291 | A1 | 7/2010 | Farley | |
| 2010/0186277 | A1 | 7/2010 | Beckmann | |

OTHER PUBLICATIONS

Final office action from U.S. Appl. No. 14/341,837 mailed Nov. 19, 2014.
Lee, Randall, U.S. Appl. No. 12/912,715, filed Oct. 26, 2010.
Lee, Randall; U.S. Appl. No. 13/953,610, filed Jul. 29, 2013.
Lee, Randall; U.S. Appl. No. 14/341,837, filed Jul. 27, 2014.
Non-final office action from U.S. Appl. No. 12/912,715 mailed Aug. 14, 2012.
Non-final office action from U.S. Appl. No. 13/953,610 mailed Oct. 9, 2013.
Notice of Allowance from U.S. Appl. No. 12/912,715 mailed Apr. 15, 2013.
Notice of Allowance from U.S. Appl. No. 13/953,610 mailed Apr. 28, 2014.
Notice of Allowance from U.S. Appl. No. 14/341,837 mailed May 27, 2015.
Notice of Allowance from U.S. Appl. No. 14/341,837 mailed Feb. 9, 2015.

* cited by examiner

RESET ASSIST MECHANISM

CROSS-REFERENCE TO RELATED APPLICATIONS

This application is a continuation of U.S. patent application Ser. No. 14/341,837, filed Jul. 27, 2014, which is a continuation of U.S. patent application Ser. No. 13/953,610, filed Jul. 29, 2013, now U.S. Pat. No. 8,819,978, issued Sep. 2, 2014, which is a continuation of U.S. patent application Ser. No. 12/912,715, filed Oct. 26, 2010, now U.S. Pat. No. 8,510,980, issued Aug. 20, 2013, all of which are incorporated in their entirety herein by reference.

FIELD OF INVENTION

This invention relates to an apparatus for enhancing the lateral movement of a trigger bar in a semi-automatic firearm when a trigger reset event occurs. In particular, this invention relates to enhancing the mechanical impact between a trigger bar and a sear as a firearm trigger is released.

BACKGROUND OF THE INVENTION

A striker-type fire control mechanism is commonly used in modern semi-automatic pistols. In striker fired pistols, the trigger is connected to a trigger bar. Movement of the trigger causes movement of the trigger bar, which in turn causes a sear to rotate about a pivot point. Upon rotation of the sear, a spring is compressed and an upper portion of the sear is displaced relative to the firing pin. Upon displacing the sear a sufficient distance to clear a depending leg of the firing pin, the firing pin is urged forward by a spring and strikes the rear of the cartridge, thereby discharging the firearm. After the firearm discharges, the trigger must be released forward to a point where the trigger bar re-engages the sear, resetting the trigger for the next shot.

In some firearms, the trigger reset is aided by a single tensioning coil spring located forward of the magazine channel. This trigger return spring performs the dual role of returning the trigger to a forward position and pulling the rear end of the trigger-bar back under the sear. During the forward return of the trigger bar, but before re-engagement with the sear, the trigger bar is laterally displaced out of cooperation with the sear such that the firearm may not yet be fired. As the trigger bar continues to move forward, the rear end of the trigger bar is pulled back under the sear, re-engaging the sear so that the firearm is again ready to fire.

The mechanical impact that occurs between the trigger bar and sear upon re-engagement physically communicates to the operator, through the operator's finger on the trigger, that the trigger reset is complete and that the firearm may be fired, i.e., that the firearm is set to fire when the trigger is pulled back again. However, because this mechanical impact can be slight, the physical communication to the operator through the trigger is subtle, and thus it can be difficult for a firearm operator to ascertain when trigger reset has occurred.

BRIEF SUMMARY OF THE INVENTION

Several embodiments of the present invention answer the above and other needs by providing a reset assist mechanism for biasing the trigger bar as the reset event occurs.

In one embodiment, the invention may be characterized as a reset apparatus for use in a firearm, comprising: a compression spring; a biasing member comprising a first end and a distal end wherein the compression spring is attached proximate to the first end of the biasing member; a notch disposed on the biasing member for cooperation with a trigger bar, wherein the trigger bar comprises a longitudinal axis defined by a front portion and a rear portion, wherein the front portion is mechanically cooperated with a firearm trigger; and wherein the compression spring communicates a force through the biasing member and onto the trigger bar in a direction substantially perpendicular to the longitudinal axis of the trigger bar.

In another embodiment, the invention may be characterized as method for signaling a trigger reset event comprising: attaching a compression spring to a biasing member, the biasing member comprising a first end and a distal end wherein the compression spring is attached proximate to the first end of the biasing member; disposing the biasing member to be in mechanical cooperation with a trigger bar, wherein the trigger bar comprises a front portion and a rear portion, the front portion being mechanically cooperated with a firearm trigger; applying a force from the biasing member onto the trigger bar in a direction substantially perpendicular to an axis of the trigger bar (longitudinal axis of the trigger bar, or longitudinal firing axis), the axis defined by the front and rear portions of the trigger bar.

In yet another embodiment, the invention may be characterized as a means for magnifying an impact resonance between a sear body and a trigger method for use with a modular irrigation controller comprising: a compression spring; a biasing member, the biasing member comprising a first end and a distal end wherein the compression spring is attached proximate to the first end of the biasing member; a notch disposed on the biasing member for cooperation with a trigger bar, wherein the trigger bar comprises a longitudinal axis defined by a front portion and a rear portion, wherein the front portion is mechanically cooperated with a firearm trigger; and wherein the compression spring communicates a force through the biasing member and onto the trigger bar in a direction substantially perpendicular to the longitudinal axis of the trigger bar.

BRIEF DESCRIPTION OF THE DRAWINGS

The above and other aspects, features and advantages of several embodiments of the present invention will be more apparent from the following more particular description thereof, presented in conjunction with the following drawings.

DETAILED DESCRIPTION

The following description is not to be taken in a limiting sense, but is made merely for the purpose of describing the general principles of exemplary embodiments. The scope of the invention should be determined with reference to the claims.

Figure 1:
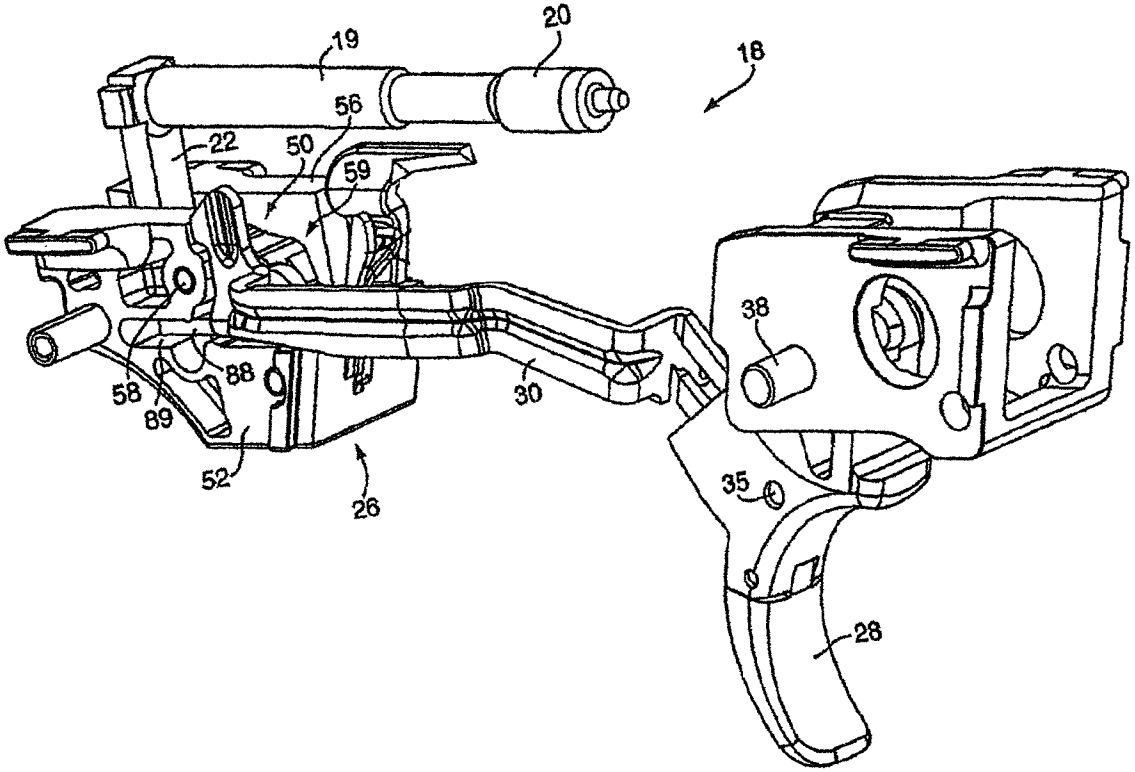
FIG. 1 is a simplified schematic perspective view of a fire control mechanism according to an embodiment of the present invention.

Referring now to FIG. 1, the fire control mechanism 18 includes a striker-type firing pin 19 having a forward firing pin portion 20 and a depending leg 22 extending down from the firing pin portion 20. The fire control mechanism 18 also includes a sear assembly 26 that is engagable by the firing pin 19. The sear assembly 26 is operably engagable with a trigger assembly that includes the trigger 28. Upon operation of the handgun (via movement of the trigger 28), a surface of the depending leg 22 selectively engages the sear assembly 26. The trigger 28 is pivotally connected to a trigger bar 30 via a pin 35. The trigger bar 30 may be biased in lateral directions via a spring or the like. Rearward movement of the trigger 28 causes movement of the trigger bar 30 in a rearward longitudinal direction. When the trigger 28 is actuated by being pressed in a rearward direction, the trigger 28 pivots about a pin 38, thereby transmitting rearward longitudinal movement to the trigger bar 30 via the pin 35. Longitudinal movement of the trigger bar 30 in a rearward direction, in turn, actuates the sear assembly 26, e.g., it unblocks the sear assembly, thereby allowing the firing pin 19 to translate in a forward direction under the action of a decompressing firing pin spring for the firing pin portion 20 to engage a cartridge and fire the handgun.

The fire control mechanism 18 is further described in U.S. Pat. No. 7,617,628 (Curry), the entirety of which is incorporated herein reference.

Figure 2:
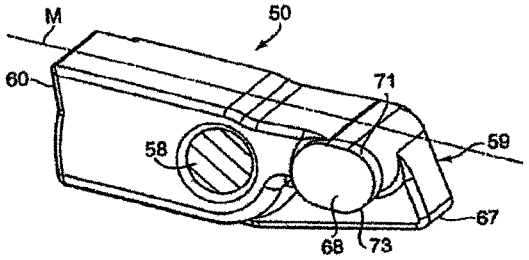
FIG. 2 is a simplified schematic perspective view of the sear of FIG. 1.

Referring now to FIG. 2, in some embodiments the sear 50 is an elongated member having a major axis M. The elongated member is pivotal about the fulcrum 58, which extends through the member in a direction that is substantially perpendicular to the direction in which the major axis M extends. The forward portion 59 of the sear 50 is configured to have both a ramp portion 67 and a cam portion 68. From a side elevation, the cam portion 68 may have a cross-sectional configuration having an upper rounded surface 71 and a lower rounded surface 73, both of which extend perpendicular to the direction in which the major axis M extends and parallel to the direction in which the pivot axis defined by the fulcrum 58 extends. The ramp portion 67 extends downward from the lower rounded surface 73. A downward-facing surface of the ramp portion 67 is substantially flat. Both the forward portion 59 and the rearward portion are dimensioned and configured to have substantially the same masses relative to the fulcrum 58. Thus, the sear 50 is substantially balanced front-to-back.

Figure 3:
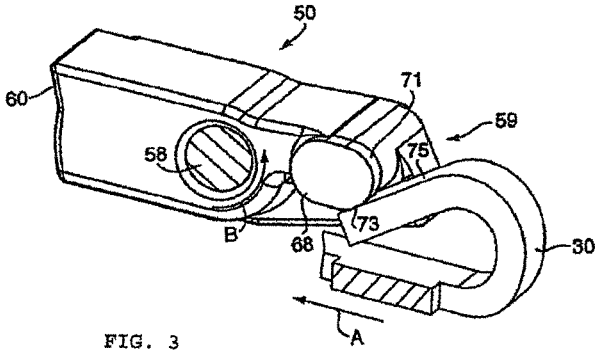
FIG. 3 is a simplified schematic perspective view of the engagement of the sear and a trigger bar of the fire control mechanism.

Referring now to FIG. 3, the dimensions and configuration of the sear 50 are such that the lower rounded surface 73 on the cam portion 68 acts cooperatively with the trigger bar 30. In particular, the lower rounded surface 73 engages a corresponding sloped surface 75 on the trigger bar 30 such that as the trigger is pulled, the trigger bar 30 moves rearward in the direction of an arrow A and in a plane that is at least partially coplanar with a plane in which the sear 50 rotates. In doing so, the sloped surface 75 on the trigger bar 30 engages the lower rounded surface 73 of the cam portion 68, the sear 50 is rotated in the direction of an arrow B, and the forward end of the sear 50 is urged upward, thereby causing the rearward surface 60 to move downward about the fulcrum 58. At a pre-selected distance, the sear 50 is pivoted fully downward against the sear spring to allow the leg 22 of the firing pin 19 to disengage from the rearward surface 60.

Figure 4:
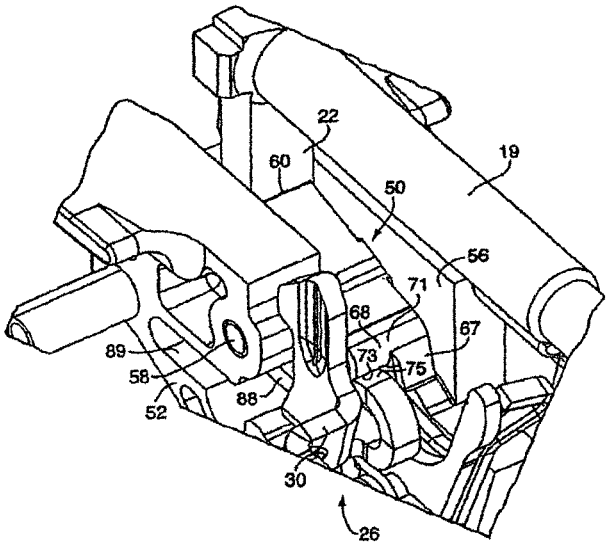
FIG. 4 is a simplified schematic view of the fire control mechanism of FIG. 1.

Referring now to FIG. 4, the depending leg 22 of the firing pin 19 is engaged by the sear 50. As the trigger is pulled in the rearward direction, the trigger bar 30 likewise moves rearward, and the sloped surface 75 on the trigger bar 30 engages the lower rounded surface 73 of the sear 50 to urge the front of the sear 50 up and the rearward surface down (the sear 50 is pivoted about the fulcrum 58). The firing pin 19 is released and travels forward. The trigger bar 30 is fully extended in the rearward direction.

Figure 5:
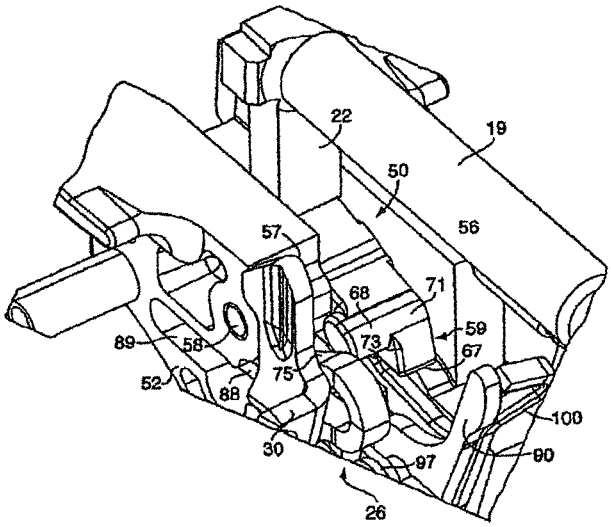
FIG. 5 is a simplified schematic view of the fire control mechanism in which the trigger bar is displaced away from the sear.

Referring now to FIG. 5, after the trigger has been released, the trigger bar 30 likewise moves forward and also laterally out of registration with the sear 50. Once the trigger bar 30 has moved sufficiently in the forward direction, the sloped surface 75 reengages the lower rounded surface 73 on the cam portion 68 of the sear 50. The trigger bar 30 may be provided with a track or guide 89 in the sear housing block 52, for the purpose of laterally guiding the trigger bar 30 during lateral displacement. As should be appreciated, the connection of the trigger 28, trigger bar 30, and the sear assembly 26 is such that the trigger bar 30 can be laterally displaced when pressure is exerted on the trigger bar 30 in a direction that is perpendicular to the direction in which the longitudinal firing axis extends.

Figure 6:
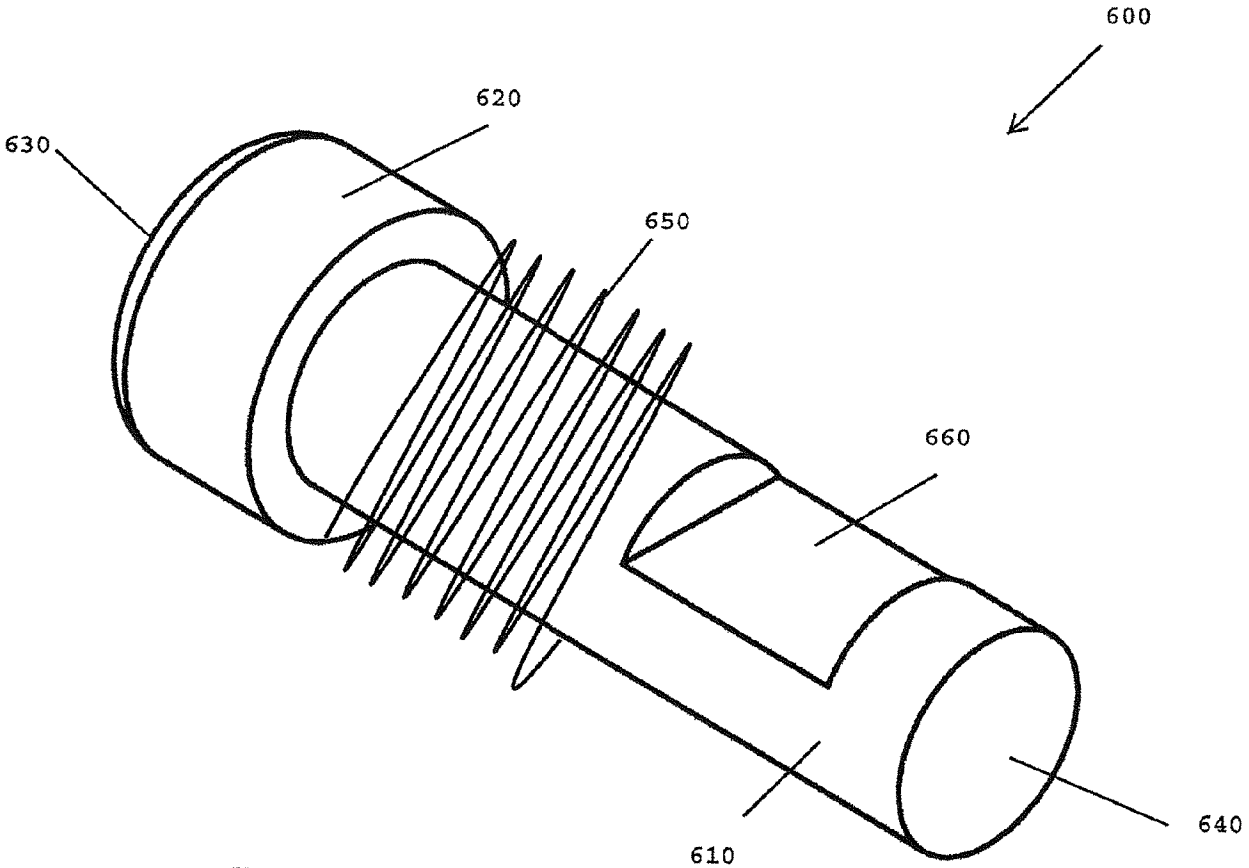
FIG. 6 is an enlarged perspective view of a biasing member of one embodiment of the present invention.

FIG. 6, is perspective view of a biasing member 600. Shown is a cylindrical rod 610, a cylindrical plunger head 620, a first end 630, a distal end 640, a compression spring 650 and a notch 660.

The biasing member 600 is comprised of the cylindrical rod 610 with the cylindrical plunger head 610 of a greater diameter and disposed on one side of the cylindrical rod 610. The top surface of the cylindrical plunger head 620 includes a surface forming the first end 630 of the biasing member 600. At the opposite end of the rod 610 is the distal end 640. The notch 660 is disposed in one surface of the cylindrical rod 610 nearer to the distal end 640 than the first end 630 of cylindrical plunger head 620. The notch 660 is of a size and shape suited to accommodate the trigger bar 30, such that the trigger bar 30 is at least partially laterally constrained, i.e., is not free to slide side-to-side independently of the biasing member 600, within the notch 660 when the biasing member 600 is cooperated with the trigger bar 30. The trigger bar 30 is not constrained longitudinally, i.e., is free to slide forward and backward independently of the biasing member 600, within the notch 660 when the biasing member 600 is cooperated with the trigger bar 30.

In operation, the biasing member 600 is cooperated with the trigger bar 30 via the notch 660. That is, the trigger bar 30 sits within notch 660 such that the longitudinal axis of trigger bar 30 is substantially perpendicular to the longitudinal axis of the biasing member 600 and parallel to the firing axis (longitudinal firing axis). In this configuration, the trigger bar 30 is allowed to move in its forward and rearward longitudinal directions as it is not fixed to any point within the notch 660 on the biasing member 600. The lateral axis of the trigger bar is substantially parallel to the longitudinal axis of the biasing member 600 and perpendicular to the longitudinal firing axis. In this configuration, the trigger bar 30 moves in its side-to-side lateral directions and is constrained within the notch 660 on the biasing member 600.

Figure 7:
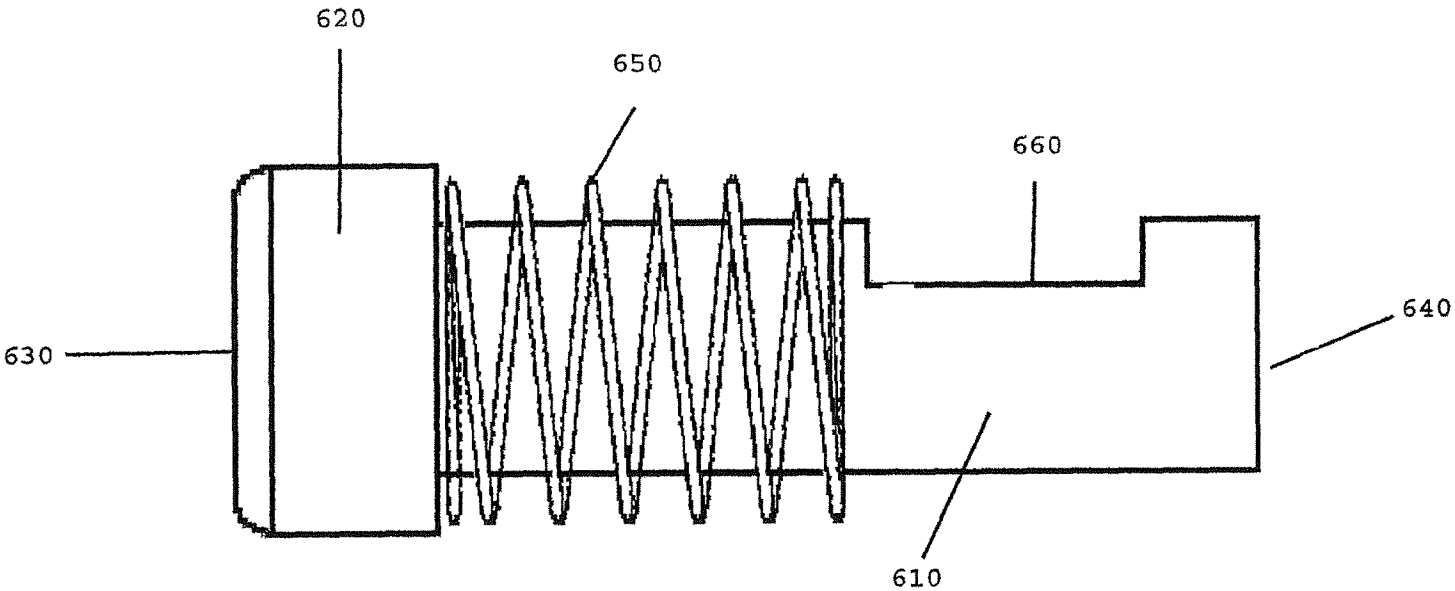
FIG. 7 is a side view of the biasing member of one embodiment of the present invention in which the biasing member is cooperated with a compression spring.

FIG. 7 is a side orthogonal view of a biasing member 600 cooperated with a compression spring 650. Shown is a rod 610 with a plunger head 620, a first end 630, a notch 660, a distal end 640 and a compression spring 650.

Fixed under the plunger head 620, is the compression spring 650 such that the rod 610 is disposed within the inner circumference of the compression spring 650. In this configuration, the compression spring 650 can be compressed against the plunger head 620 in response to lateral displacement of the trigger bar 30 such that movement of the rod 610 and the plunger head 620 causes compression of the compression spring 650.

In operation, the notch 660 is cooperated with the trigger bar 30 such that the trigger bar 30 freely moves in the forward and backward longitudinal directions. However, the notch 660 will affect the motion of the trigger bar 30 in the lateral direction perpendicular to the longitudinal axis (longitudinal firing axis) of the trigger bar 30. When lateral displacement of the trigger bar 30 occurs, the compression spring 650 compresses against the plunger head 620 and around the rod 610, translating a lateral force into the trigger bar 30 via the notch 660.

Figure 8:
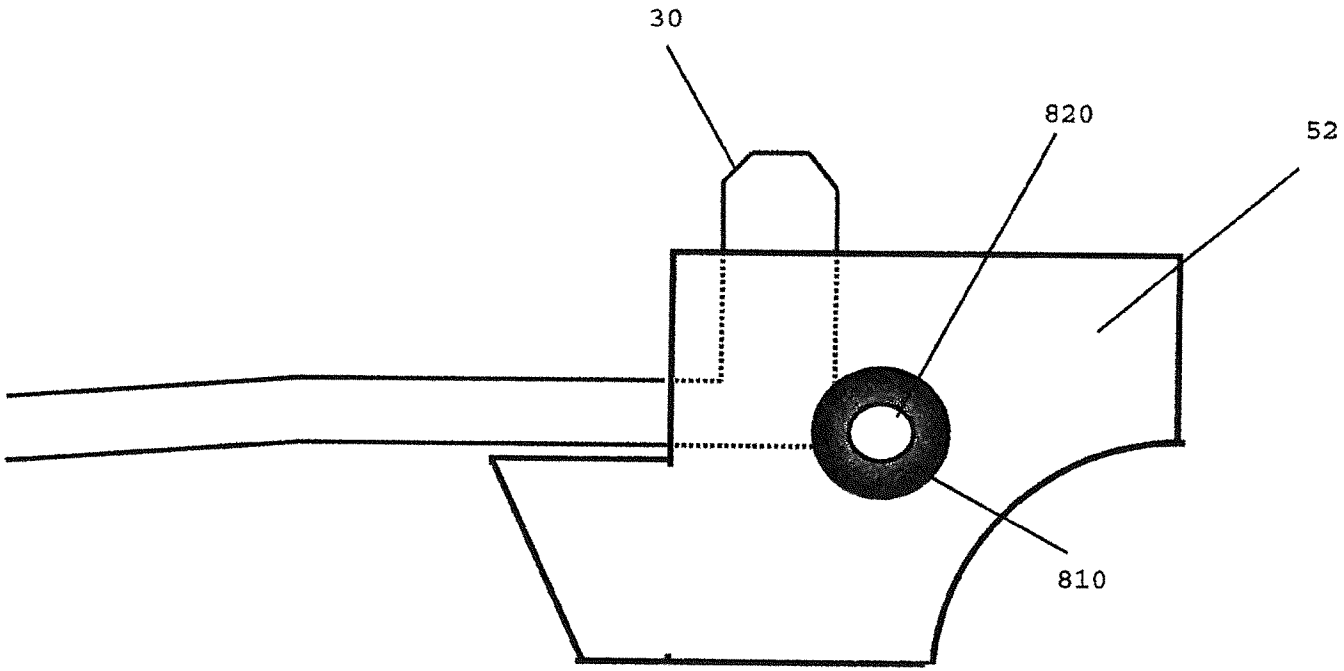
FIG. 8 is a left side view of the a sear housing block including a sear channel and an interior flange.

FIG. 8 is a left perspective view of a sear housing block 52. Show is a trigger bar 30, a sear housing block 52, a sear channel 810 and a flange 820.

The sear channel 810 is a cylindrical hole in the sear housing block 52 in a direction perpendicular to the longitudinal axis (longitudinal firing axis) of the trigger bar 30. The diameter of the sear channel 810 is narrowed by the flange 820 disposed within the sear channel 810 and beneath the surface of the sear housing block 52. The dimensions of the sear channel 810 and the flange 820 are such that the distal end 640 of the biasing member 600 can fit into the inner diameter of the flange 820 within the sear channel 810. However, the diameter of the compression spring 650 is larger than the inner diameter of the flange 820 and yet smaller than the inner diameter of the sear channel 810. Thus, when the biasing member 600 is inserted into the sear channel 810, the compression spring of the biasing member presses up against the flange 820 permitting the rod 610 to move in the lateral direction relative to the longitudinal axis of the trigger bar 30 as the compression spring 650 is compressed or decompressed.

In practice, the biasing member 600 together with the compression spring 650 is inserted into the sear channel 810. Because of the relative dimensions of the compression spring 650 and the rod 610, the larger diameter compression spring cooperates with the flange 820 allowing the rod 610 to penetrate sear housing block 52 via the inner diameter of the flange 820. Inside the sear housing block 52, the trigger bar 30 cooperates with the notch 660 on the rod 610 such that when the trigger bar 30 moves in a lateral direction, a lateral force is imparted on the rod 610 via the notch 660 causing the compression or decompression of the compression spring 650. Compression of the compression spring 650 occurs when the trigger bar 30 is moved laterally in a direction away from the left side of the sear housing block 52. Upon compression of the compression spring 650, the biasing member 600 exerts a force of opposite direction on trigger bar 30. This force exerted by the biasing member 600 tends to restore the trigger bar 30 back into cooperation with the sear 50.

Figure 9:
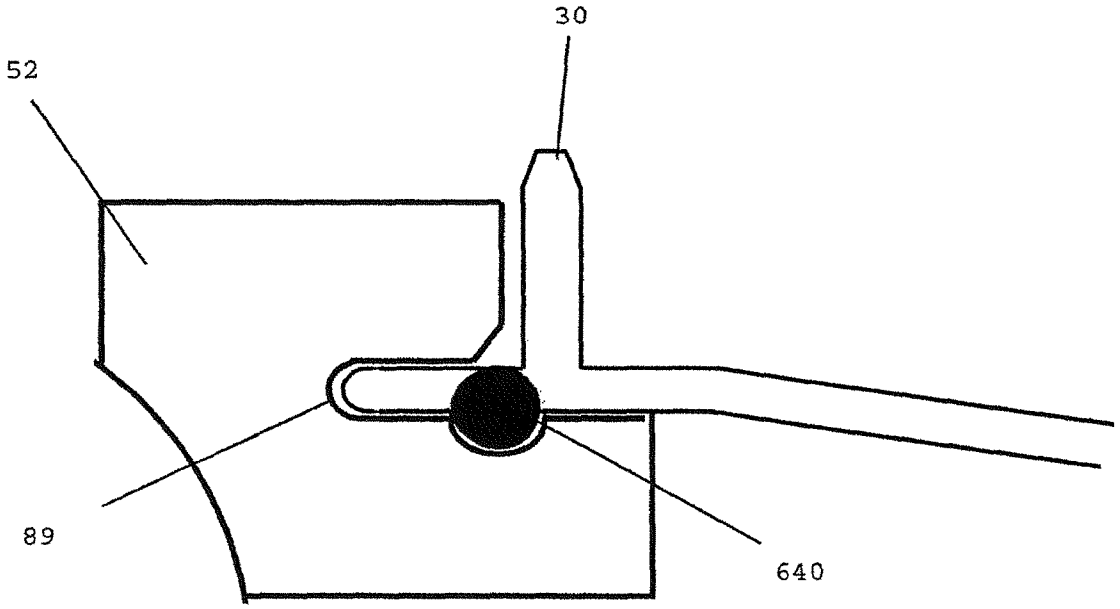
FIG. 9 is a right side view of the sear housing block including a channel and trigger bar (in this perspective view, a distal end of the biasing member is also shown)

FIG. 9, is a right perspective view of a sear housing block 52. Shown is a trigger bar 30, a guide 89 and a distal end 640 of a biasing member 600.

The biasing member 600, is shown inserted into the sear channel 810 and mechanically cooperated with the trigger bar 30 such that the distal end 640 is visible from the right perspective view of the sear housing block 52. The geometry of the guide 89 is such that the trigger bar 30 is moveable along its lateral axis.

In practice, when the trigger bar 30 is laterally displaced, the biasing member 600 exerts a restoring force on the trigger bar 30, in a direction into the page, forcing the trigger bar 30 back into mechanical cooperation with the sear 50.

Figure 10:
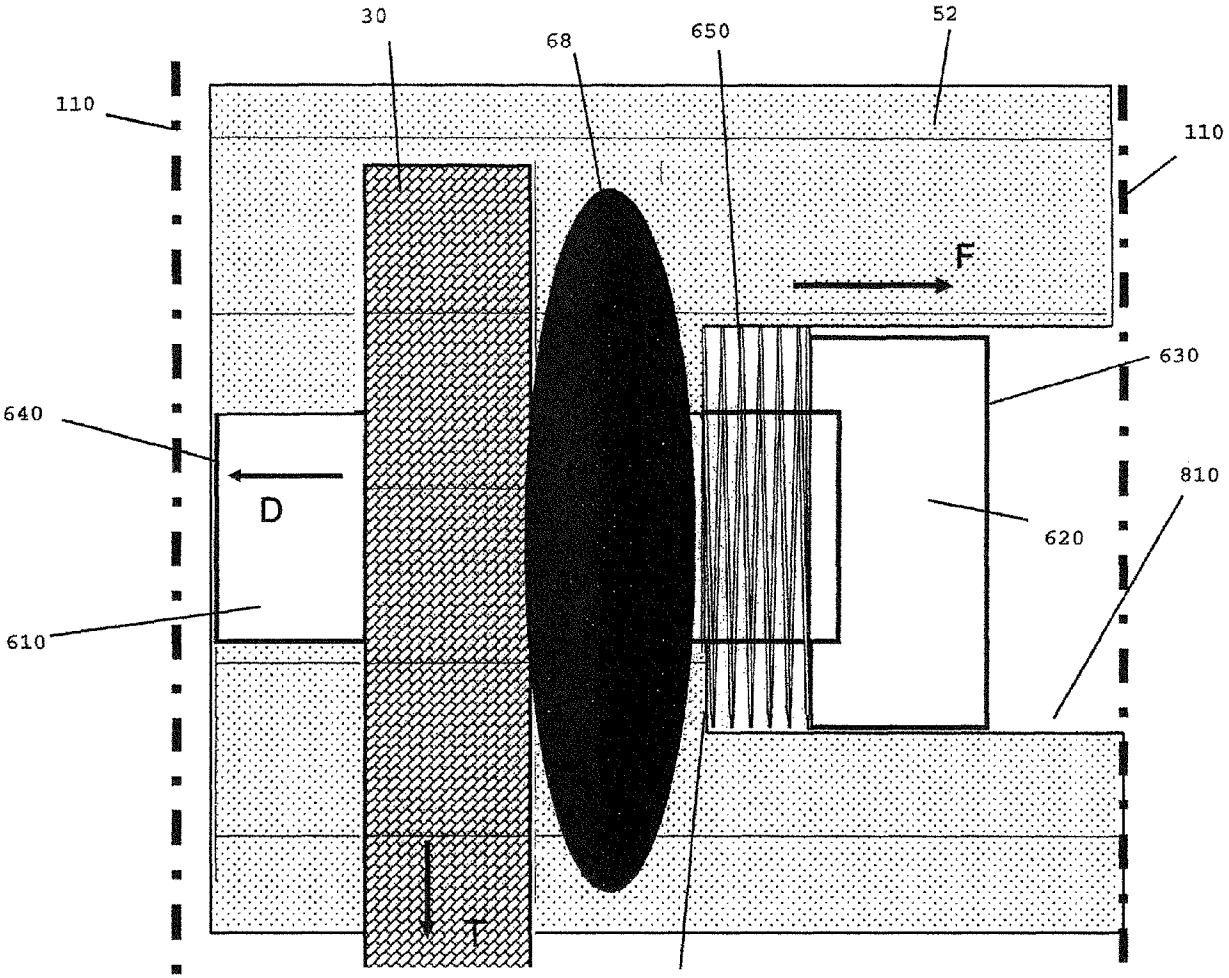
FIG. 10 is a cut-away top view of the sear housing block in which the biasing member and the compression spring are mechanically cooperated with the trigger bar (the trigger bar is laterally displaced in the direction indicated by arrow D out of cooperation with cam portion 68; in this configuration, the compression spring 650 is compressed between the plunger head of biasing member and the sear flange such that a force is exerted on the trigger bar in the direction indicated by arrow F)

FIG. 10 depicts a top perspective cut away view of the sear housing block 52, wherein the biasing member 600 is fully inserted into the sear channel 810 and mechanically cooperated with the trigger bar 30 and wherein the trigger bar 30 is displaced laterally out of cooperation with cam portion 68. Shown is the distal end 640, the rod 610, the cam portion 68, the compression spring 650, the plunger head 620, the first end 630, the flange 820 and the frame 110.

In this configuration, the cam portion 68, the biasing member 600 and the trigger bar 30 are all disposed within the sear housing block 52. The cam portion 68 is elevated above the trigger bar 30 which is in turn disposed above the biasing member 600. Mechanically cooperated, the trigger bar 30 and the biasing member 600 are laterally displaced in the direction of arrow D such that plunger head 620 is pulled into sear channel 810. Lateral displacement of the trigger bar 30 and the biasing member 600 results in compression of compression spring 650 against flange 820.

In practice, after a shot has been fired, the trigger bar 30 is pulled in the forward longitudinal direction, indicated by arrow T, by a trigger return spring (not depicted) that is located forward of the magazine channel. During this forward return, the trigger bar 30 is laterally displaced out of cooperation with the cam portion 68 of the sear 50. While the trigger bar 30 is laterally displaced out of cooperation with the sear 50, the firearm may not yet be fired. Due to the mechanical cooperation between the trigger bar 30 and the biasing member 600, the lateral displacement of trigger bar 30 results in a corresponding lateral displacement of the biasing member 600 with respect to the longitudinal axis (longitudinal firing axis) and in the direction of arrow D. The displacement of the biasing member 600 in turn causes the compression of the compression spring 650 between the plunger head 620 and the flange 820 such that the compression spring 650 exerts a force on the plunger head 30 in the direction indicated by arrow F. This force is translated along the rod 610 and into the trigger bar 30 so that the trigger bar 30 is also forced in the lateral direction of arrow F. This restoring force will tend to return the trigger bar 30 under the cam portion 68 such that the trigger bar 30 is re-cooperated with the sear 50. Upon reengagement with the sear 50 by the trigger bar 30, the trigger reset event will be complete, allowing the fire to be fired.

Absent the biasing member 600 of the present embodiment, a stock firearm relies on the forward force provided by a trigger return spring in the direction of arrow T in order to both laterally restore the trigger bar 30 into cooperation with the sear 50 and return the trigger to a forward position. Thus, in the event that the trigger return spring were to malfunction, trigger reset would be difficult because there is no method with which to re-position the trigger bar 30 beneath the cam portion 68 such that the trigger bar 30 and the sear 50 are mechanically cooperated. However, with the present embodiment, due to the lateral force imparted on the trigger bar 30 by the biasing member 600, the trigger bar 30 maintains a relationship with the cam portion 68. As such, trigger reset can be accomplished so long as the firearm operator is able to manually restore the trigger 28 to a forward position.

Figure 11:
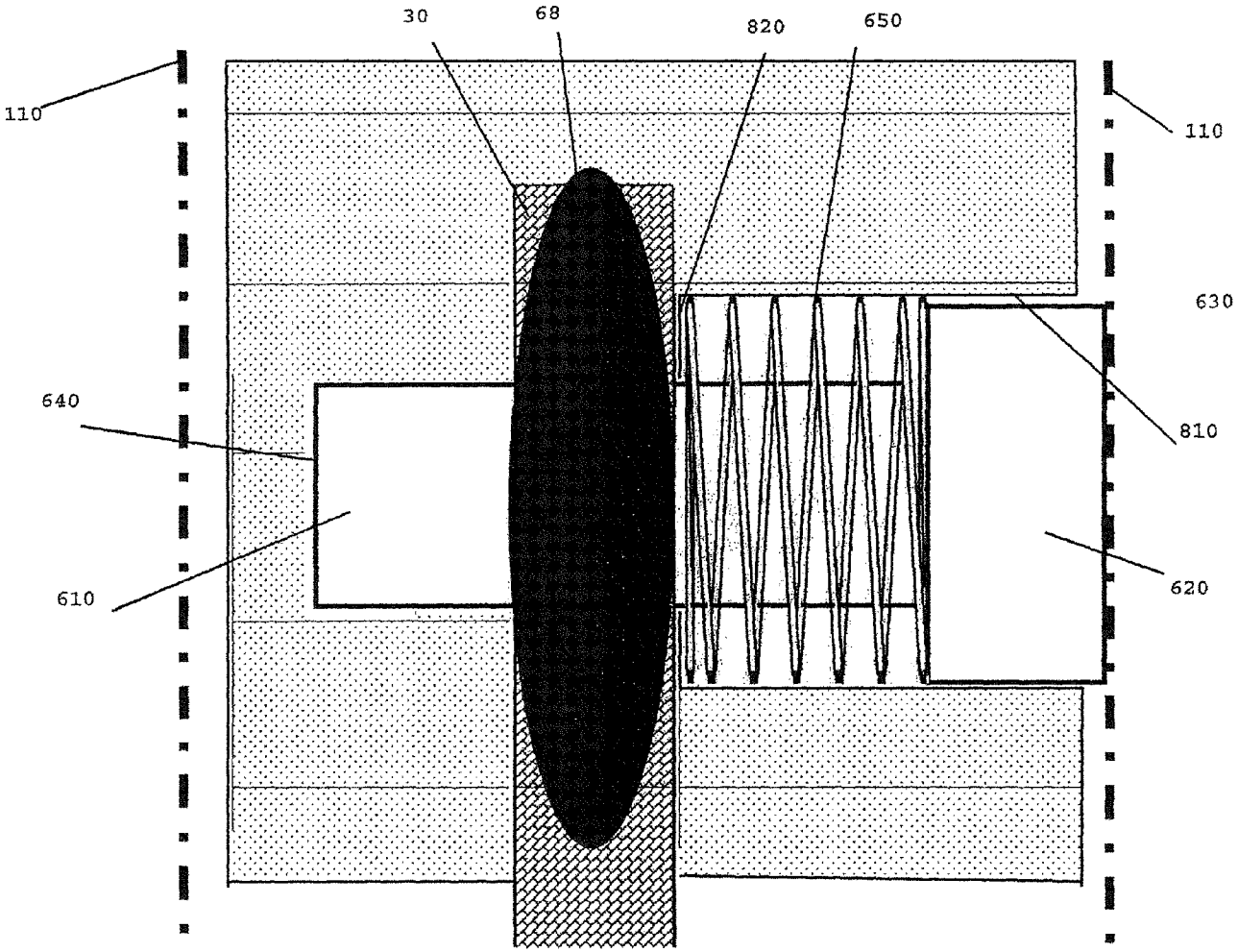
FIG. 11 is a cut-away top perspective view of the sear housing block in which the biasing member and the compression spring are mechanically cooperated with the trigger bar (in this configuration, the trigger bar has been returned to its laterally unbiased position and is in cooperation with sear disposed under the cam portion).

FIG. 11 depicts a top perspective cut away view of the sear housing block 52, wherein biasing member 600 is inserted into the sear channel 810 and mechanically cooperated with the trigger bar 30 and wherein the trigger bar 30 is mechanically cooperated with the cam portion 68. Shown is a distal end 640, a rod 610, a cam portion 68, a compression spring 650, a plunger head 620, a first end 630, a flange 820 and a frame 110.

In this configuration, mechanically cooperated, the trigger bar 30 and the biasing member 600 are laterally restored such that the trigger bar 30 is re-cooperated with the sear 50. As such, the compression spring 650 is disposed between the flange 820 and the plunger head 620 and is uncompressed. In this position, the first end 630 of the plunger head 620 is in contact with the interior frame surface 110.

In practice, it is the impact resonance that occurs between the trigger bar 30 and the sear 50 upon re-engagement, that physically communicates to the operator, that the trigger reset (trigger reset event) is complete, i.e., that the firearm may be fired. However, in firearms lacking the benefits of the present embodiment, the mechanical impact between the trigger bar 30 and the sear 50 upon re-engagement can be so insignificant, that it is often difficult for an operator to ascertain when the re-cooperation has occurred, i.e., when the trigger reset has completed. More specifically, in most stock firearms, there is only one lateral force exerted on the trigger bar 30 that originates from the trigger return spring. However, the trigger return spring, located forward of the magazine channel, is too distant from the location of the trigger reset event to cause an appreciable mechanical impact as the trigger bar 30 rejoins the sear 50.

The biasing member 600 of the present embodiment serves to enhance the mechanical impact between the trigger bar 30 and the sear 50 without adversely affecting the trigger pull weight. As the trigger bar 30 moves in the forward longitudinal direction of arrow T, the lateral displacement of the trigger bar 30 is corrected by both the lateral restoring force imparted by biasing member 600 and the lateral force due to the effects of the trigger return spring. That is, in some embodiments, the trigger bar 30 receives a lateral restoring force from two independent sources, the trigger return spring and the biasing member 600. The addition of the lateral force contributed by biasing member 600 enhances the mechanical impact between the trigger bar 30 and the sear 50 as the trigger bar 30 and the sear 50 reconnect. This added force in turn enhances the impact resonance at the trigger reset event, allowing an operator to more easily ascertain when the reset even has occurred. Furthermore, the longitudinal movements of the trigger bar 30 are not significantly impeded by the mechanical cooperation with the notch 660 of the biasing member 600. Because the trigger bar 30 is allowed to slide freely in the forward and rearward longitudinal directions within the notch 660, the mechanical cooperation of the trigger bar 30 and the biasing member 600 does not impact the trigger pull weight.

Additionally, a secondary impact resonance is created between the first end 630 of the biasing member 600 and the interior surface of the frame 110. As the compression spring 650 decompresses and the trigger bar 30 is laterally biased back into cooperation with the sear 50, the biasing member 600 is also laterally biased, in the direction opposite of arrow D, such that the plunger head 620 re-emerges from the sear channel 810 such that the first end 630 of the plunger head 620 contacts the interior of the frame 110. This mechanical impact contributes a secondary impact resonance to the operator, facilitating an indication of when the trigger reset event has occurred.

What is claimed is:

1. A reset mechanism for use in a semi-automatic firearm, comprising:

a biasing member comprised of a cylindrical rod with a cylindrical head of greater diameter than the cylindrical rod and disposed on one end of the cylindrical rod;

a notch disposed on a side of the cylindrical rod, the notch configured for cooperation with a trigger bar when the reset mechanism is installed in a sear channel in the semi-automatic firearm, wherein the notch is configured to allow the trigger bar to move substantially unabated along a longitudinal firing axis;

wherein the biasing member is configured such that when a lateral movement of the trigger bar results in lateral movement of the biasing member, the biasing member exerts a restoring force on the trigger bar in a direction opposite to the lateral movement of the trigger bar.

2. The reset mechanism of claim 1, wherein the restoring force forces the trigger bar into mechanical cooperation with a sear body.

3. The reset mechanism of claim 2, wherein the mechanical cooperation of the trigger bar with the sear body creates an impact resonance between the trigger bar and the sear body.

4. The reset mechanism of claim 2, wherein the restoring force forces the cylindrical head to impact a frame of the firearm.

5. The reset mechanism of claim 4, wherein the impact of the cylindrical head on the frame creates an impact resonance between the cylindrical head and the frame.

6. The reset mechanism of claim 2, wherein the reset mechanism is configured to fit within a sear channel.

7. A method of making of a reset mechanism for a semi-automatic firearm, comprising:

forming a biasing member comprised of a cylindrical rod with a cylindrical head of greater diameter than the cylindrical rod and disposed on one end of the cylindrical rod, the cylindrical rod including a diameter to fit within an inner diameter of a sear channel flange of the firearm, and the cylindrical head configured to fit within the inner diameter of the sear channel of a firearm;

forming a notch on a side of the cylindrical rod, the notch configured for cooperation with a trigger bar of the firearm when the reset mechanism is installed in the sear channel, wherein the notch is configured to allow the trigger bar to move substantially unabated along a longitudinal firing axis;

wherein the biasing member is configured such that when a lateral movement of the trigger bar results in lateral movement of the biasing member, the biasing member exerts a restoring force on the trigger bar in a direction opposite to the lateral movement of the trigger bar.

8. A method of using a reset mechanism of a semi-automatic firearm, comprising:

disposing a biasing member in a sear channel of the firearm such that a trigger bar in a pre-firing lateral position is in mechanical cooperation with the biasing member;

firing of the firearm, whereby the trigger bar is moved at least in a direction substantially perpendicular to a firing axis of the firearm and away from a cylindrical head; and imparting of a restoring force onto the trigger bar by the reset mechanism, wherein the restoring force restores the trigger bar to the pre-firing lateral position.

9. The method of using a reset mechanism according to claim 8, wherein the restoring force does not increase a trigger force required to actuate the firearm trigger.

10. The method of using a reset mechanism according to claim 8, wherein the restoring force allows the reset mechanism to reset the firearm to be fired again when a trigger return spring has failed.

11. The method of using a reset mechanism according to claim 10, further comprising moving the trigger bar generally along the firing axis towards a barrel end of the firearm by a user of the firearm after firing the firearm when the trigger return spring has failed.

12. The method of using a reset mechanism according to claim 8, wherein the restoring force results in a mechanical cooperation of the trigger bar with a sear body.

13. The method of using a reset mechanism according to claim 12, wherein the mechanical cooperation creates an impact resonance between the trigger bar and the sear body.

14. The method of using a reset mechanism according to claim 8, wherein the restoring force results in the cylindrical head impacting a frame of the firearm.

15. The method of using a reset mechanism according to claim 14, wherein the impact of the cylindrical head on the frame creates an impact resonance between the cylindrical head and the frame.

* * * * *